US007739766B2

(12) United States Patent
Lecinq et al.

(10) Patent No.: US 7,739,766 B2
(45) **Date of Patent: *Jun. 22, 2010**

(54) METHOD FOR ERECTING A STAY

(75) Inventors: Benoit Lecinq, Fontenay aux Roses (FR); Jean-Pierre Messein, Villers les Nancy (FR); Jean-Claude Percheron, Vienne en Arthies (FR); Craig Robertson, Queensland (AU)

(73) Assignee: Freyssinet International (STUP) (FR)

( * ) Notice: Subject to any disclaimer, the term of this patent is extended or adjusted under 35 U.S.C. 154(b) by 1308 days.

This patent is subject to a terminal disclaimer.

(21) Appl. No.: 10/739,776

(22) Filed: Dec. 18, 2003

(65) Prior Publication Data

US 2006/0185318 A1 Aug. 24, 2006

(30) Foreign Application Priority Data

Dec. 18, 2002 (FR) ..... 02 16090

(51) Int. Cl.
*E01D 11/00* (2006.01)
*E01D 11/04* (2006.01)

(52) U.S. Cl. ..... 14/22; 14/18; 14/19; 14/23; 52/223.13; 52/223.14

(58) Field of Classification Search ..... 52/223.2, 52/223.4, 223.5, 223.6–223.14; 14/18–22
See application file for complete search history.

(56) References Cited

U.S. PATENT DOCUMENTS 4,473,915 A 10/1984 Finsterwalder
5,461,743 A 10/1995 Stubler et al.
5,803,641 A 9/1998 Nutzel
6,523,207 B1 * 2/2003 Stubler et al. ..... 14/22

FOREIGN PATENT DOCUMENTS

EP 0 421 862 A1 4/1991
EP 0 654562 A1 5/1995

OTHER PUBLICATIONS

French Preliminary Search Report, from the European Patent Office dated 2003.

* cited by examiner

*Primary Examiner*—Jeanette Chapman
(74) *Attorney, Agent, or Firm*—Banner & Witcoff, Ltd.

(57) ABSTRACT

A stay comprises an inclined casing and a bundle of substantially parallel taut reinforcements lodged in the casing and individually anchored in a first and a second anchoring region. According to the invention, the casing and some of the reinforcements are installed by applying substantially uniform tension values to the reinforcements, then several iterations of the following steps are formed: compacting the installed reinforcements, at least at one end of the casing; slipping a further group of reinforcements along inside the casing, in a space left available by the compacted reinforcements; and tensioning each reinforcement of the further group between the first and second anchoring regions so that all the installed reinforcements exhibit substantially uniform tension values.

18 Claims, 5 Drawing Sheets

METHOD FOR ERECTING A STAY

CROSS REFERENCE TO RELATED APPLICATIONS

This application claims priority to France Patent Application Ser. No. FR 02 16090, filed Dec. 18, 2002, which is incorporated herein by reference in its entirety.

BACKGROUND OF THE INVENTION

The present invention relates to the installation of taut reinforcements such as strand parts inside a casing to produce a stay belonging to the suspension system for a civil engineering construction.

In a stayed suspension, one or more towers support a structure, such as the deck of a bridge for example, via a collection of stays following oblique paths between a tower and the structure. A stay is a cable made up of a collection of reinforcements stretched between two end anchor points and generally surrounded by a casing. These reinforcements are often metal strand parts. In the case of a stayed bridge, each reinforcement is anchored to a tower and to the deck of the bridge that it plays a part in supporting.

European Patent 0 421 862 describes a method for tensioning the strand parts of a stay which advantageously allows the tensions to be evened out across the various strand parts while at the same time using a single strand part jack, which is far more lightweight and easier to handle (especially on a tower) than a communal jack. According to that method, a first strand part is tensioned to form a control strand part. Each subsequent strand part is tensioned using the single strand part jack until its tension matches that of the control strand part. In the course of this operation, the tension in the strand parts already anchored decreases a little as the tension in the new strand part increases. Gradually, this procedure ensures that the various strand parts in the stay are tensioned to the same value.

For large constructions, the stays used are typically very long, of a length which may be as much as several hundred meters, and a high number of taut elementary reinforcements (strand parts or the like) has to be provided in order to withstand the load.

Furthermore, on stayed constructions with a very long span (in excess of 500 meters), the drag load on the sheaf of stays is dominant over the action of the wind on the deck and may lead to appreciable over-engineering of the towers. As the drag is 10 proportional to the diameter of the casing, it is therefore desirable to provide stays with a small-diameter casing, that is to say stays that are more compact.

It is thus necessary to reach a delicate compromise between the number of strand parts per stay, that needs to be maximized in order to increase the supporting capacity of the stay, and its diameter, that needs to be minimized for aerodynamic reasons.

Now, it is generally necessary, within the casing, to provide enough space for the reinforcements to run in when the stay is being put in place. This is because the stays used in large bridges are very heavy, which means that it is not conceivable for them to be hauled up into position having prefabricated them on the deck or at a prefabrication area. In general, the casing is set in place along the oblique path of the stay, then the strand parts are installed one by one, or in small groups, hauling them up into position using a shuttle sliding along inside the casing and driven by a winch placed on the tower. When the last strand part (or the last group) is being hauled up, there still needs to be enough space in the casing to allow the shuttle to pass. It is clearly desirable for this remaining space to be minimized, in the search for the above compromise.

EP-A-O 654 562 gets around this problem by making the casing out of several shell sections assembled around the bundle of strand parts once the latter has been tensioned, thus allowing only a minimum amount of space to be left. However, for the overall design of the stay, it is decidedly preferable to provide a casing made as a single piece rather than made in several parts. This in particular affords the reinforcements better protection against environmental attack.

One object of the present invention is to provide a satisfactory solution to the abovementioned problem.

SUMMARY OF THE INVENTION

The invention thus proposes a method for erecting a stay comprising an inclined casing and a bundle of substantially parallel taut reinforcements housed in the casing and individually anchored in first and second anchoring regions, the reinforcements being put in place in groups of N reinforcements, N being a number greater than or equal to 1. The casing and some of the reinforcements are installed by applying substantially uniform tension values to the reinforcements. The method then comprises the following:

a. compacting the installed reinforcements, at least at one end of the casing;
b. slipping a further group of reinforcements along inside the casing, in a space left available by the compacted reinforcements;
c. tensioning each reinforcement of the further group between the first and second anchoring regions so that all of the reinforcements installed have substantially uniform tension values; and
d. repeating steps [a} to [c] until installation of the reinforcements is complete.

Such installation of the reinforcements of the stay allows the reinforcements to be positioned uniformly within the casing. Having tension that is uniform across reinforcements that have similar characteristics ensures that they follow parallel paths. Compacting them at one end of the casing, or both, then allows them to be gathered together into a compact formation over practically the entire length of the casing, thus maximizing the space available for the insertion of the next reinforcements. The need to increase the cross section of the casing with a view to facilitating the insertion of the last reinforcements is therefore not as great. The method is well suited to the production of stays of small cross section for a given number of reinforcements, thus minimizing windage.

In order to carry out step [b], it is advantageous for each reinforcement of the further group to be temporarily attached to a shuttle to which there are fixed a first line running towards the first anchoring region and connected to a hauling-up winch, and a second line running towards the second anchoring region and connected to a hauling-down winch.

The further group of reinforcements is preferably slipped along inside the casing by actuating the hauling-up winch while the hauling-down winch is operated in such a way as to force the second line in the opposite direction. Having slipped the further group through the casing, the shuttle can then be brought back down again by actuating the hauling-down winch while the hauling-up winch is operated in such a way as to force the first line in the opposite direction.

This shuttle preferably comprises a support and means for temporarily fixing each reinforcement of the further group, these means being placed on a concave face of the support. In one particular embodiment, use is made, for the shuttle, of a first support during at least one first iteration of steps [a] to [c] then of at least one second support during at least one second iteration of steps [a] to [c] subsequent to the first iteration, the second support being smaller than the first support. This makes it possible to take account of the increasingly small space left available in the casing as the reinforcements are gradually threaded through.

Each reinforcement may consist of a strand part comprising a central wire and several peripheral wires twisted around the central wire. To perform step [b], it is then advantageous to chop the peripheral wires off in an end portion of each reinforcement of the further group and to attach the central wire to the means for temporary attachment of the shuttle to that end portion.

The shuttle may include, in at least some of the iterations of steps [a] to [c], means for parting the reinforcements of the further group from the compacted reinforcements, it being possible for these means to comprise at least one roller mounted to pivot about an axis substantially perpendicular to the first and second lines. This roller presses against the compacted reinforcements as the shuttle and the reinforcements of the further group are hauled through when the space available becomes smaller, to prevent friction from damaging the reinforcements. A roller may in particular be mounted at the front of the shuttle relative to a direction of travel of the shuttle through the casing during step [b].

Step [a] of compacting the installed reinforcements advantageously involves the compacting of the said reinforcements according to a template that has a cross section with an upper portion of substantially circular overall shape having d diameter of the order of one inside diameter of the casing. The cross section of the template preferably has, during at least some of the iterations of steps [a] to [c], a lower portion of substantially planar or concave overall shape.

In step [a], the installed reinforcements are advantageously compacted at both ends of the casing.

BRIEF DESCRIPTION OF THE DRAWING

In the detailed description which follows reference will be made to the drawing comprised of the following Figures.

DESCRIPTION OF THE PREFERRED EMBODIMENTS

Figure 1:
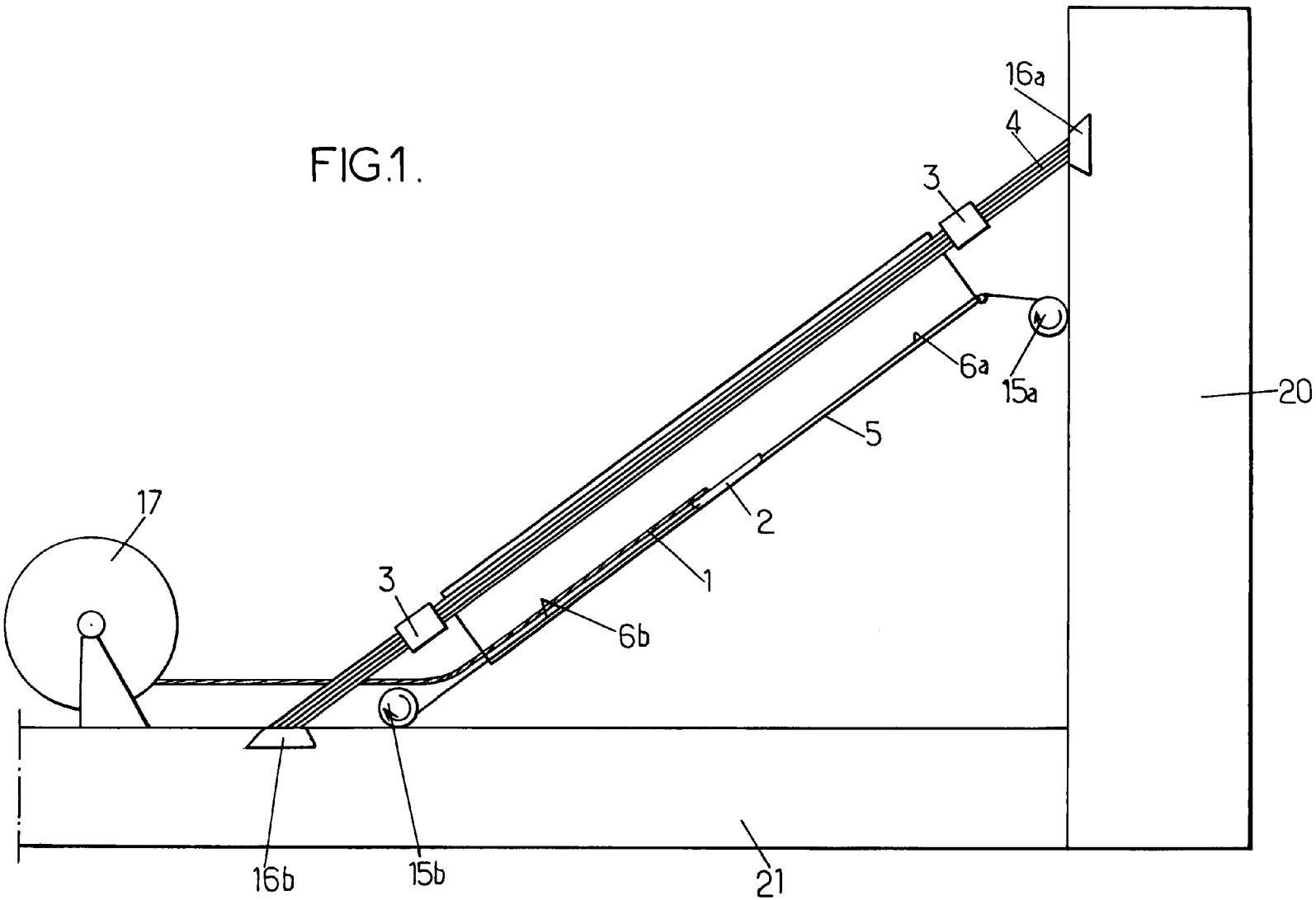
FIG. 1 is an outline diagram illustrating a method according to the invention in the context of a stayed bridge.

The invention finds an application in particular in the field of stayed bridges. Here we consider a stay contained in a casing 5 and stretching between a tower 20 and the deck 21 (FIG. 1). The stay in question may be very long, for example, in excess of a 100 meters long. It may contain a potentially high number of elementary reinforcements, of the order of one hundred or more.

The reinforcements of the stay consist in strand parts 4 grouped together into a bundle housed within the casing 5. Each strand part is tensioned and anchored at its two ends in two anchoring regions 16*a*, 16*b* one situated on the tower 20 and the other on the deck 21, respectively. The anchoring means placed in the regions 16*a*, 16*b* may be of conventional type with, for example, an anchor block bearing against the structure and equipped with frustoconical orifices to accommodate frustoconical jaws wedged about each strand part.

In a first step of the method for erecting the stay, the casing is set in place along its oblique path between the two anchoring regions, at the same time as a first strand part or as a first set of strand parts tensioned and anchored at their two ends. The casing 5 rests from there on the strand part or parts already set in place. During this first step, moving gear comprising a shuttle 2 and two lines 6*a*, 6*b*, all described later on, are also placed in the casing 5.

The first strand parts 4 to be installed do not generally present any placement problems in so far as_the space available inside the casing 5 is sufficient for the strand parts to be inserted therein with ease. These strand parts are paid out from a reel 17 placed on the deck of the bridge, or from a strand-part storage site when these strand parts have already been pre-cut. They are then threaded through the casing, for example hauling them up from the deck 21 towards the tower 20 using a hauling-up winch 15*a* installed on the tower. During this phase, it is possible to use the same shuttle 2 as the one which will be described later on.

To prevent entangling of the already-installed strand parts, these are positioned in such a way that they are more or less mutually parallel along their entire length. For that, each strand part is placed at corresponding positions on the two anchor blocks. This may be achieved by symmetrically numbering the frustoconical orifices that have corresponding positions in the blocks situated in the regions 16*a*, 16*b* and by introducing each strand part into orifices that have the same number at each end.

Prior to anchoring, each strand part threaded through the casing is tensioned so that the various strand parts already taut have uniform tension values, for example using the method described in European Patent 0 421 862. As the strand parts have an identical make-up and are anchored at geometrically corresponding positions in the two blocks, this allows the various strand parts to be given paths that are practically parallel between the two anchor regions.

The space occupied by the strand parts inside the casing may therefore remain small, including in the central part of the casing that is difficult to access. As the casing presses against the installed strand parts, the lower part of its cross section remains available for the insertion of the subsequent strand parts.

However, after a certain length of time, it becomes tricky to introduce further strand parts into the casing 5 because the space available in the casing is no longer sufficient for the unencumbered passage of the shuttle 2. At each anchor block, it is necessary to provide a certain separation between the strand parts so as to be able to arrange the frustoconical orifices while at the same time giving the block sufficient robustness. The strand parts already set in place along parallel paths therefore occupy a significant amount of space in the casing, and this may impede the insertion of subsequent strand parts.

To avoid these difficulties, the already-anchored strand parts 4 are compacted to bunch them together along their path, and the shuttle 2 to which the further strand part 1 or group of strand parts to be slipped through the casing is attached (FIG. 1) is placed in the space available left at the bottom of the casing 5.

When the further strand part 1 or further group of strand parts is being threaded through, the shuttle 2 is driven by a line 6*a* pulled by the hauling-up winch 15*a* placed on the tower 20. Symmetrically, another line 6*b* is fixed to the shuttle 2 and runs downwards to a hauling-down winch 15*b*. This winch 15*b* is activated to bring the shuttle 2 back down once the further strand part or further group of strand parts hauled up has been detached.

In a preferred embodiment, when the further strand part 1 is being hauled up by the winch 15*a*, the hauling-down winch 15*b* is also activated in order to force the line 6*b* and the shuttle in the opposite direction. Likewise, as the shuttle 2 is being returned by the winch 15*b*, the hauling-up winch 15*a* is also activated to force the line 6*a* and the shuttle in the opposite direction. These steps mean that the shuttle+lines assembly is always under tension as the shuttle moves along in the bottom of the casing 5, ensuring that this assembly follows a uniform path along the casing and minimizing the risks of its becoming entangled with the strand parts.

The compacting of the strand parts already installed is performed at least at one end of the casing 5 by means of a compacting system 3. The identical conditions under which the strand parts are tensioned means that this local compaction is propagated along the entire length of the stay, thus maximizing the space available for the shuttle 2 to run in. To enhance this effect, it is judicious to provide a compacting system 3 at each end of the casing 5, as shown in FIG. 1.

Figure 2A:
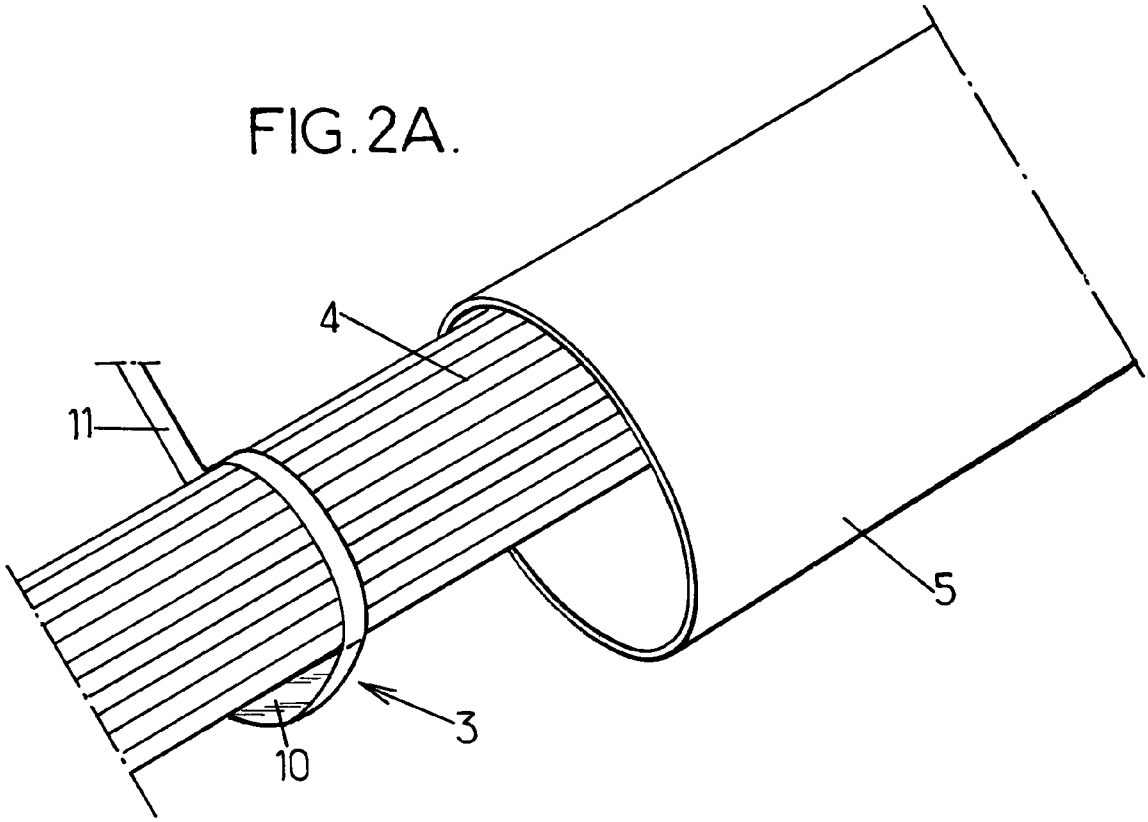
FIG. 2A illustrates an example of compacting means that can be used in one embodiment of the invention.

As depicted in FIG. 2A, the system 3 advantageously compacts the already-installed reinforcements 4 according to a template the cross section of which has an upper portion of roughly circular overall shape, the diameter of this circular shape being equal to the inside diameter of the casing or similar to this diameter. The casing 5 then rests on the bundle of compacted strand parts, losing the minimum amount of space at the upper part, and therefore freeing up the maximum amount of space in the lower part of the casing to make it easier for the shuttle 2 to run.

Figure 2B:
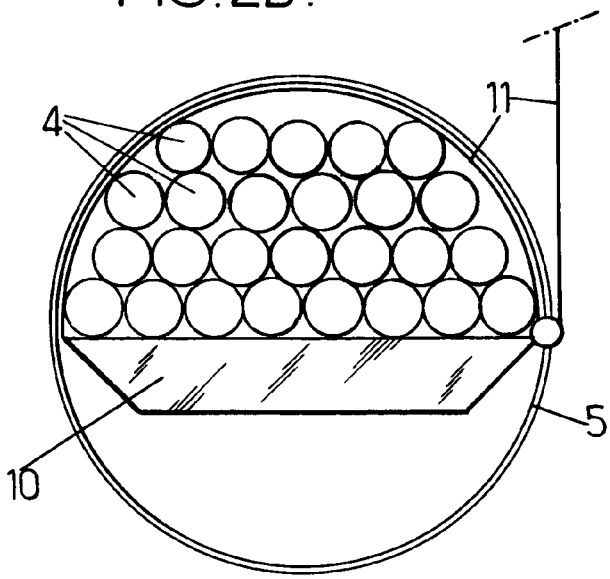
FIG. 2B is a cross section of the compacting means of FIG. 2A.

In the embodiment of the invention illustrated in FIG. 2A and in the cross section of FIG. 2B, the compacting system 3 comprises a strap 11 to surround the bundle of strand parts with the interposition of a wedge 10. The wedge 10 defines the lower portion of the cross section of the compaction template.

Several shapes of wedge 10 may be envisaged. FIG. 3A shows one exemplary embodiment of such a wedge 10. The latter comprises two parts: an upper part 12*a* which is placed in direct contact with the strand parts 4 to be compacted, and a lower part 13 receiving the strap 11.

In FIG. 3A, the upper part 12*a* of the wedge 10 is planar, which means the lower portion of the cross section of the compaction template is of planar overall shape. This upper part 12*a* is preferably made of an elastomeric material in contact with the strand parts 4 to avoid damaging them during compaction. The lower part 13*a* of the wedge 10, which may have various shapes, is made of a rigid material such as wood.

Figure 3B:
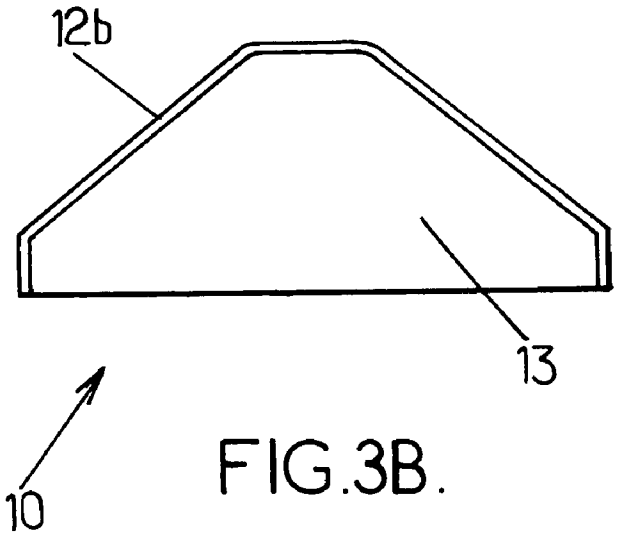
FIGS. 3A and 3B are views of two examples of a wedge that can be used in the compacting means of FIG. 2A.
Figure 3A:
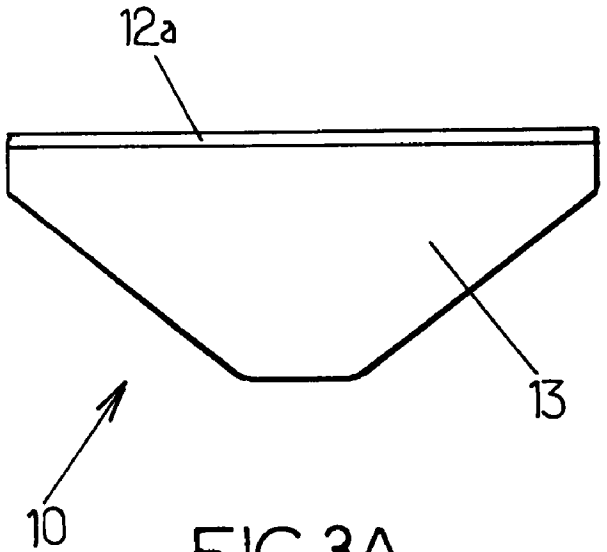

In the alternative form of FIG. 3B, the elastomeric upper part 12*b* of the wedge 10 is convex, which means the lower portion of the cross section of the compaction template is concave.

Of course other compaction systems 3 may be used. The closeness of the strand parts 4 to one another and the magnitude of the space left available inside the casing by the bundle thus formed reflect their effectiveness.

Figure 5:
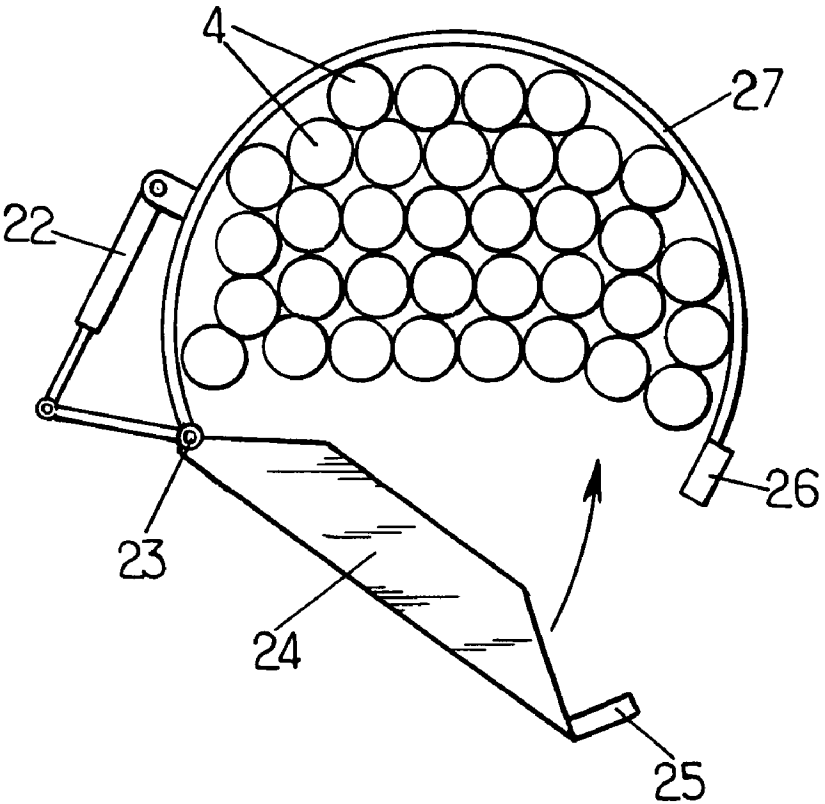
FIG. 5 illustrates another example compacting means that can be used in one embodiment of the invention.

For example, use may be made of a mechanical system as illustrated in FIG. 5. This system consists of a rigid chassis 24 and of an upper part 27 to encircle the strands 4 that are to be compacted. It also comprises a hydraulic jack 22 fixed to the upper part 27 of the mechanical compaction system. This jack actuates the chassis 24 about an axis of rotation 23 associated with the chassis, so as to open up and close the system around the strand parts 4. This system is advantageously designed to allow rapid opening and closure, to avoid losing time in the strand-part-threading cycle.

Figure 6:
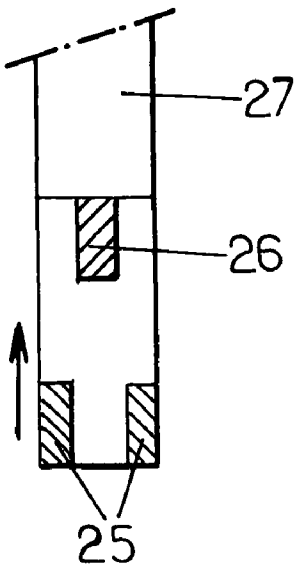
FIG. 6 is a view of a closing and opening system for the compacting means of FIG. 5.

FIG. 6 schematically shows one example of a closing and opening system for the mechanical compaction system of FIG. 5. A tooth 26 is fixed to the upper part 27 of the mechanical system. Two other teeth 25 are fixed to the chassis 24. These teeth 25 are designed to be able to position themselves on each side of the tooth 26 as the system is closed. This advantageous arrangement makes it possible to avoid the strand parts 4 leaving the mechanical system when the latter is in the closed position.

Thus, the compaction of the already-anchored strand parts 4 makes it possible to free up space inside the casing to allow the passage of the shuttle 2 bearing a further strand part 1. Installation of the strand part 1 then consists in placing the shuttle in the space left available in the casing 5 during compaction, that is to say in the bottom of the casing, then in actuating the hauling-up winch 15*a* to pull the shuttle 2 along the casing 5 using the line 6*a*.

Once it has reached the other end of the casing 5, the further strand part 1 is detached from the shuttle 2 so that it can be anchored into the region 16*a*, and the anchored strand parts 4 are decompacted by removing the systems 3. If the further strand part 1 is not prefabricated, that is to say is not pre-cut, the strand part 1 is also chopped off level with the deck 21 to detach it from the reel 17 and offer it up to the anchor block in the region 16*b*. This further strand part is tensioned and anchored in the same way as the previous strand parts 4. In particular, after anchorage, equal tension values are obtained for the strand part 1 and for the already-installed strand parts 4, for example using the method of European Patent 0 421 862.

The compaction template becomes increasingly fat as further strand parts are installed, this gradually decreasing the space available for the passage of the shuttle 2. It is possible to provide several interchangeable shuttles of different sizes, and to begin by using the largest shuttle (which has a more stable path through the casing when the space available is relatively large) and to haul the last strand parts through using a smaller shuttle.

It is also possible to use different compaction systems as further strand parts are installed. For example, it is possible to begin with a wedge of the kind shown in FIG. 3A, defining a compaction template that is flat at the base, and to continue using a wedge of the kind shown in FIG. 3B, defining a compaction template that is concave at the base.

When further strand parts 1 are being installed, and right up to the installation of the last one, the same operations may be repeated. As a preference, the strand parts are installed in successive layers, beginning with the positions situated at the top of the casing and gradually descending towards the strand parts occupying the lower positions.

Furthermore, the shuttle 2 advantageously has a structure that minimizes the size of its cross section. The shuttle illustrated in FIGS. 4A and 4B comprises a support 14 which may rest on the bottom of the casing 5 as it makes its outbound and return journeys. This support 14 may advantageously be made of sheet metal and have a semicylindrical shape.

Advantageously, the support 14 of the shuttle 2 is removable, so that it can be used as long as the bundle of strand parts already installed does not impede the progress of the shuttle inside the casing, whereas it can be withdrawn when the space left empty by the already-anchored strand parts 4 becomes too tight to allow the shuttle to progress unencumbered with its support. It is also possible to envisage several removable supports of decreasing size.

The shuttle 2 comprises a cradle 7 intended to accommodate the end of a further strand part that is to be hauled up through. Thus, a further strand part 1 to be set in place may be positioned in a cradle 7 of the shuttle 2 and may be fixed into this cradle using temporary fixing means. These means (not depicted in FIGS. 4A and 4B) can easily be removed so that an operator working on the construction of the bridge can quickly detach the strand part 1 from the shuttle 2 so as to offer the strand part up to the anchoring region 16*a*.

A strand part usually comprises a central wire and six peripheral wires twisted around the central wire. To attach it to the cradle 7 of the shuttle, one possibility is to chop off the six peripheral wires in an end portion 1*a* of the strand part, as shown schematically in FIG. 4A, and to wedge the central wire in a small anchoring device, not depicted, for example involving frustoconical jaws, housed in the cradle 7. This arrangement makes it possible to minimize the cross section of the cradle and of the shuttle in its entirety.

Figure 4B:
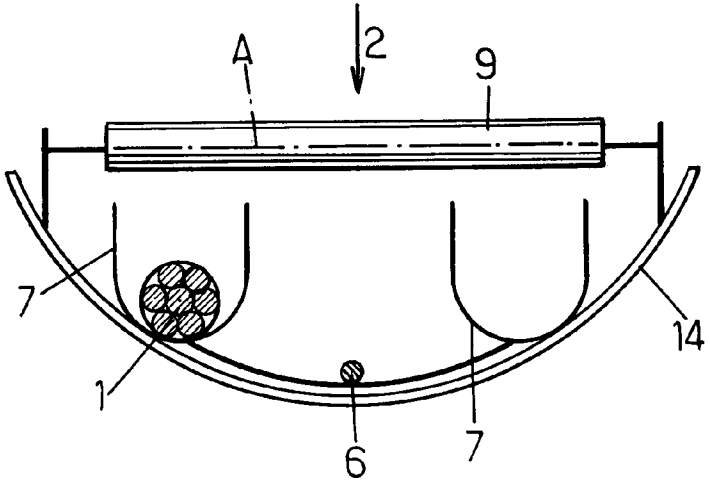
FIGS. 4A and 4B are a view from above and an end-on view of a shuttle used in one embodiment of the invention.
Figure 4A:
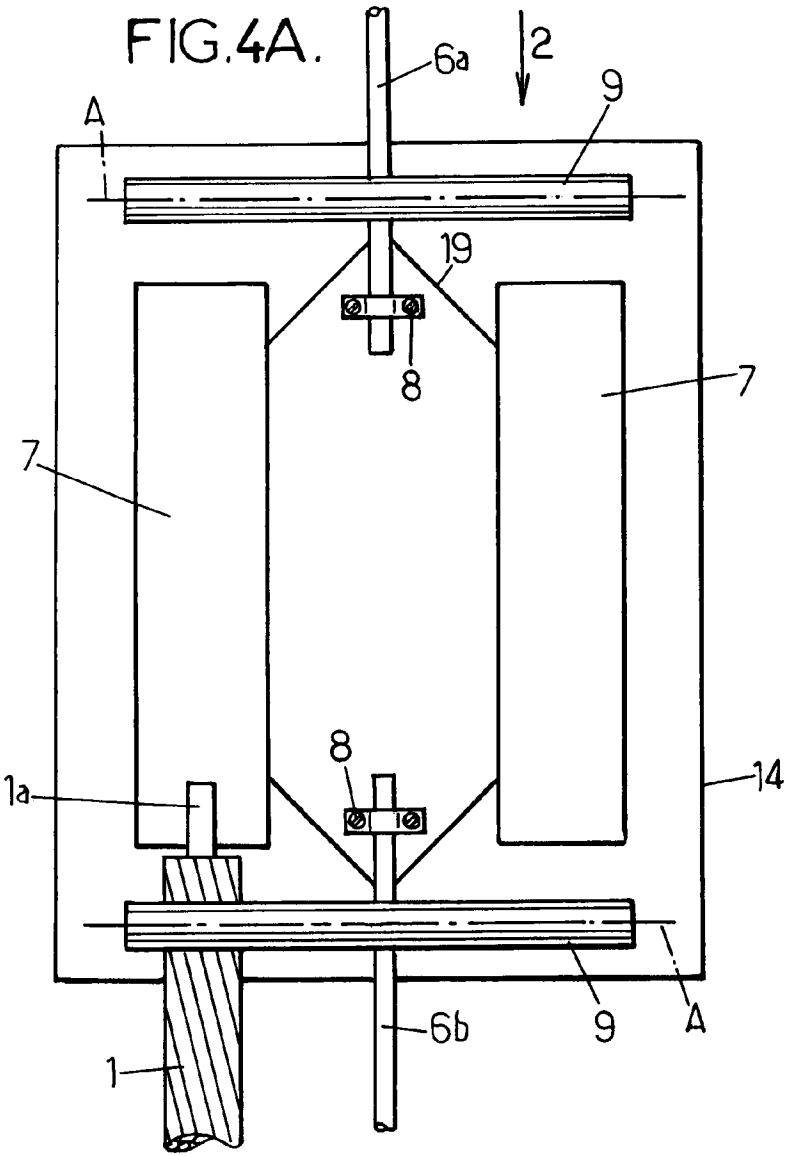

It may be noted that several strand parts may be pulled simultaneously from one anchoring region to the other. In the case of a group of N strand parts ($N \geqq 1$), there are N cradles on the shuttle, so that each cradle can hold one of the N strand parts of the group. In FIGS. 4A and 4B two cradles 7 have been depicted by way of example. It is possible to vary the number N as the strand parts are gradually installed, particularly to reduce it so as to reduce the size of the shuttle 2 at the end of installation.

The shuttle 2 also comprises means 8 for attaching the lines' 6*a*, 6*b*, which may be of any kind. For example, the end of each line 6*a* and 6*b* may be fixed using screws 8 to a base 19 associated with the support 14 and to which the cradles 7 are attached.

The shuttle 2 advantageously comprises means for parting the further strand part 1 from the anchored and compacted strand parts 4. In the embodiment illustrated, these means comprise two rollers mounted to pivot on the shuttle about axes A mounted on the support 14 or the base 19 and perpendicular to the lines 6*a*, 6*b*. These rollers 9 are interposed between the support 14, the lines 6*a*, 6*b* and the further strand part 1 to prevent the strand parts and/or the lines from becoming entangled and to prevent the moving shuttle from rubbing against the strand parts already in place and risking damaging them. It is possible to provide just one roller 9 on the shuttle, preferably at the front of the shuttle with respect to the direction of travel of the shuttle inside the casing during hauling.

What is claimed is:

1. Method for erecting a stay comprising an inclined casing and a bundle of substantially parallel taut reinforcements housed in the casing and individually anchored in first and second anchoring regions, the reinforcements being put in place in groups of N reinforcements, N being a number greater than or equal to 1, in which method the casing and some of the reinforcements are installed by applying substantially uniform tension values to the reinforcements, characterized in that it then comprises the following steps:

a. compacting the installed reinforcements, at least at one end of the casing;

b. slipping a further group of reinforcements along inside the casing, in a space left available by the compacted reinforcements;

c. tensioning each reinforcement of the further group between the first and second anchoring regions so that all of the reinforcements installed have substantially uniform tension values; and d. repeating steps [a] to [c] until installation of the reinforcements is complete.

2. Method according to claim 1 in which, in order to carry out step [b], each reinforcement of the further group is temporarily attached to a shuttle to which there are fixed a first line running towards the first anchoring region and connected to a hauling-up winch, and a second line running towards the second anchoring region and connected to a hauling-down winch.

3. Method according to claim 2, in which the further group of reinforcements is slipped along inside the casing by actuating the hauling-up winch while the hauling-down winch is operated in such a way as to force the second line in the opposite direction.

4. Method according to claim 2, In which, having slipped the further group through the casing, the shuttle is brought back down again by actuating the hauling-down winch while the hauling-up winch, is operated in such a way as to force the first line in the opposite direction.

5. Method according to claim 2, in which the shuttle comprises a support and means for temporarily fixing each reinforcement of the further group, these means being placed on a concave face of the support.

6. Method according to claim 5, in which use is made, for the shuttle, of a first support during at least one first iteration of steps [a] to [c], then of at least one second support during at least one second iteration of steps [a] to [c] subsequent to the first iteration, the second support being smaller than the first support.

7. Method according to claim 5, in which each reinforcement consists of a strand part comprising a central wire and several peripheral wires twisted around the central wire and in which, to perform step [b], the peripheral wires are chopped off in an end portion of each reinforcement of the further group and the central wire is attached to the means for temporary attachment of the shuttle to the end portion.

8. Method according to claim 2, in which the shuttle includes, in at least some of the iterations of steps [a] to [c], means for parting reinforcements of the further group from the compacted reinforcements.

9. Method according to claim 8, in which the means for parting the reinforcements comprise at least one roller mounted to pivot on the shuttle about an axis substantially perpendicular to the first and second lines.

10. Method according to claim 9, in which a roller is mounted at the front of the shuttle relative to a direction of travel of the shuttle through the casing during step [b].

11. Method according to claim 1, in which step [a] of compacting the installed reinforcements involves the compacting of the said reinforcements according to a template, that has a cross section with an upper portion of substantially circular overall shape having a diameter of the order of one inside diameter of the casing.

12. Method according to claim 11, in which the cross section of the template has, during at least some of the iterations of steps [a] to [c], a lower portion of concave overall shape.

13. Method according to claim 1, in which, in step [a], the installed reinforcements are compacted at both ends of the casing.

14. Method according to claim 11, in which the cross section of the template has, during at least some of the iterations of steps [a] to [c] a lower portion of substantially planar overall shape.

15. Method for erecting a stay comprising an inclined casing and a bundle of substantially parallel taut reinforcements housed in the casing and individually anchored in first and second anchoring regions, the reinforcements being put in place in groups of N reinforcements, N being a number greater than or equal to 1, in which method the casing and some of the reinforcements are installed by applying substantially uniform tension values to the reinforcements, characterized in that it then comprises the following steps:

a. compacting by compressing the installed reinforcements, at least at one end of the casing;

b. slipping a further group of reinforcements along inside the casing, in a space left available by the compacted reinforcements;

c. tensioning each reinforcement of the further group between the first and second anchoring regions so that all of the reinforcements installed have substantially uniform tension values; and d. repeating steps [a] to [c] until installation of the reinforcements is complete.

16. Method according to claim 1 in which the casing has an inside diameter and step [a] of compacting the installed reinforcements involves the compacting of the said reinforcements according to a template that has a cross section with an upper portion of substantially circular overall shape having a diameter of the order of one inside diameter of the casing.

17. Method according to claim 15 in which said casing includes opposite ends and in step [a] the installed reinforcements are compacted at both ends of the casing.

18. Method for erecting a stay comprising an inclined casing and a bundle of substantially parallel taut reinforcements housed in the casing and individually anchored in first and second anchoring regions, the reinforcements being put in place in groups of N reinforcements, N being a number greater than or equal to 1, in which method the casing and some of the reinforcements are installed by applying substantially uniform tension values to the reinforcements, characterized in that it then comprises the following steps:

a. compacting by compressing the installed, uniformly tensioned reinforcements, at least at one end of the casing;

b. slipping a further group of reinforcements along inside the casing, in a space left available by the compacted reinforcements;

c. tensioning each reinforcement of the further group between the first and second anchoring regions so that all of the reinforcements installed have substantially uniform tension values; and d. repeating steps [a] to [c] until installation of the reinforcements is complete.

* * * * *